US011060291B2

(12) United States Patent
Gramling

(10) Patent No.: US 11,060,291 B2
(45) Date of Patent: Jul. 13, 2021

(54) GUTTER FLASHING

(71) Applicant: Karl J. Gramling, Boerne, TX (US)

(72) Inventor: Karl J. Gramling, Boerne, TX (US)

( * ) Notice: Subject to any disclaimer, the term of this patent is extended or adjusted under 35 U.S.C. 154(b) by 0 days.

(21) Appl. No.: 16/284,614

(22) Filed: Feb. 25, 2019

(65) Prior Publication Data

US 2020/0270868 A1 Aug. 27, 2020

(51) Int. Cl.
*E04D 13/04* (2006.01)
*E04D 13/158* (2006.01)
*E04D 13/072* (2006.01)

(52) U.S. Cl.
CPC ..... *E04D 13/0481* (2013.01); *E04D 13/0459* (2013.01); *E04D 13/0725* (2013.01); *E04D 13/158* (2013.01); *E04D 2013/0468* (2013.01)

(58) Field of Classification Search
CPC ..... E04D 13/0481; E04D 13/0459; E04D 13/0725; E04D 2013/0468; E04D 13/158
See application file for complete search history.

(56) References Cited

U.S. PATENT DOCUMENTS 4,594,820 A * 6/1986 Render ..... E04D 13/15 52/60
4,601,135 A * 7/1986 Ellis ..... E04D 1/30 52/529
5,170,597 A * 12/1992 Stearns ..... E04D 13/0459 52/11
6,035,587 A * 3/2000 Dressler ..... E04D 13/0459 52/716.2
D569,011 S * 5/2008 Brochu ..... D25/138
8,959,853 B2 * 2/2015 Bortell ..... E04D 13/0459 52/219
10,077,558 B2 * 9/2018 Heo ..... E04D 13/15
10,132,085 B2 * 11/2018 Bredeweg ..... E04D 13/158
10,370,855 B2 * 8/2019 Gassman ..... E04D 13/178
2019/0071873 A1 * 3/2019 Dye ..... E04D 13/0459

* cited by examiner

*Primary Examiner* — Adriana Figueroa
(74) *Attorney, Agent, or Firm* — Robert L. McRae; Gunn, Lee & Cave, P.C.

(57) ABSTRACT

An improved gutter flashing is disclosed. The gutter flashing can be installed on a preexisting fascia board of a building, and is compatible with the installation gutter hangers, leaf protection devices, and pre-existing drip edges or gutter flashing. The gutter flashing can be installed without placing additional holes for screws, nails or other securing devices other than the attaching devices that attach the gutter to the fascia board. The gutter flashing comprises a lower spacer portion, a substantially vertical arm with a substantially u-shaped spacing portion to receive the lower angled leg of the preexisting drip edge. Diverter arm rests on top of the roof portion of the preexisting drip edge and extends into approximately the midline of the gutter to divert water away from the structure and into the gutter.

12 Claims, 4 Drawing Sheets

GUTTER FLASHING

BACKGROUND OF THE INVENTION

1. Field of the Invention

Applicant's invention relates to a gutter system, and specifically an improved gutter flashing that is attachable to a pre-existing gutter flashing, or otherwise may be installed on a roofline and associated fascia boards without a pre-existing gutter flashing of a building or house. The present invention is designed to be held in place by the same screws or nails that hold the gutters in place, thus eliminating the need to place extra holes in the improved gutter flashing of the present invention.

2. Description of the Related Art

For years property owners have struggled with the destructive effects of water on their buildings. However, by channeling the water away from the structure, building owners can reduce the damage caused by water. This is typically done through the use of gutter systems to channel water off of the roof and away from the foundation and the fascia boards adjacent the roof decking. An important part of any gutter system is the gutter flashing. Typically, gutter flashings will slide underneath the shingle of the roof, between a shingle along the periphery of the roof decking, and extend down to abut next to the adjacent fascia board, providing a space between the fascia board and the attached gutter. A typical gutter flashing will have a small leg extending outward along a lower portion. The gutter flashing allows water to drip away from the fascia board as it seeps in between the gutter's inner vertical wall and the drip edge, thereby saving the fascia board from rotting and other negative effects of water runoff.

However, typical drip edge designs are not always capable of diverting water away from the fascia board to prevent rotting. Moreover, water running along the lower angled leg of a drip edge may roll underneath and come in contact with the fascia board due to the short length of an angled leg member.

Others have tried to improve on the prototypical fascia board and gutter flashing/drip edge design by employing systems that attempt to prevent water runoff from leaking in between the gutter and the fascia board/drip edge. Some have attempted to improve gutter flashing designs and water run off by employing devices that are inserted between the roof decking and extending downward within the gutter itself. However such structures raise the shingles and expose the roof decking, thus damaging the shingle and exposing the roof to potential damage from water runoff.

Others have attempted to provide various spacers that extend and attach to the inside of the gutter to control the water runoff from seeping behind the gutter and onto the fascia board. Yet, some others have attempted to provide elongated an extended drip edges that are nailed onto the shingle and through the roof decking. However, such devices are not adequate to channel water runoff away from the drip edge and directly into the gutter, and most must be secured via a screw, nail or other securing device. Thus, the rotting problems associated with placing holes in the roof decking and/or fascia board remain.

Other devices of the prior art require the existing drip edge to be removed in order to install the new construction. This requires substantial labor in removing the various components of the gutter system just to remove the drip edge and expose the fascia board for the new drip edge to be installed. Another problem associated with the drip edges of the prior art is that they invade the space of the interior portion of the gutter, thereby disrupting the ability to be able to place gutter hangars and leaf protection devices on top of the gutter. Thus leaf protection is compromised by the drip edges of the prior art that extend within the gutter.

BRIEF SUMMARY OF THE INVENTION

The present invention is different than the prior art. The present invention is designed such that it may be installed along a fascia board to divert water runoff from the roof line to the interior portion of a gutter, which further diverts the water away from the fascia board. The gutter flashing is attached to the fascia board by the gutter screw. With the top portion diverting water to the middle of the gutter, any concern of placing the gutter screw through the gutter and gutter flashing of the present invention and into the fascia board is alleviated. In another aspect of the invention, the gutter flashing of the present invention is capable of sliding over and receiving an existing drip edge or gutter flashing without the need to remove the same. The present invention comprises a lower portion with a substantially u-shaped bottom portion which serves as a spacer to space the present invention from the fascia board. The lower u-shaped portion should be of sufficient horizontal length to receive any typical preexisting drip edge. The present invention comprises a vertical member that extends substantially upward toward the top portion of the gutter flashing of the present invention.

Above the vertical portion, an angled arm extends upward and outward, away from the fascia board and roof decking. The angled arm begins substantially at the junction of where the roof decking meets the fascia board, and extends between the edge of the roof and the top edge of the inner wall of the gutter, above the gutter. At the top of the angled arm, a lower diverter arm extends downward and away from the roof line and fascia board, and extends substantially to the longitudinal midline of the gutter, above the gutter. The lower diverter arm terminates prior to and above the surface of any gutter hangars or leaf protection devices, or both. The lower diverter arm may be of varying angles to accommodate different pitches of roof line, and in one embodiment, may be bendable upward or downward to ensure water runoff into the interior of the gutter.

There is also a second, upper diverter arm which extends from the top of the angled arm upward and away from the angled arm, towards the roof line, and terminates in a substantially u-shape portion. This substantially u-shaped portion is designed to aid in sliding under a preexisting shingle with ease without having the gutter flashing of the present invention "catch" on the bottom side of the shingle, as would occur with a straight edge. In one embodiment, the lower diverter arm and the upper diverter arm, which join at the top portion of the angled arm, comprises substantially straight downwardly angled surface to allow water to run across the gutter flashing of the present invention and into the central portion of the gutter, thereby diverting all water runoff into the center of the gutter, several inches away from the roof structure and fascia board. This downward design minimalizes any water rollback along the lower portion of the lower diverter arm which could potentially leak back into the fascia board, because what little water rolls around the terminating edge of the lower diverter arm would have to travel of upward and inward several inches towards the roof and fascia board in order to get behind the pre-existing drip edge to damage the fascia board.

In another aspect of the present invention, the upper diverter or arm and the lower diverter arm form a downward angle, whereby the lower diverter arm is angled at a lower angle than the upper diverter arm, but still substantially extending into the midline of the gutter. This design is made to accommodate different roofing angles while still accomplishing the task of the present invention to direct all water runoff into the central portion of the gutter. In another embodiment of the present invention, the lower diverter arm extends from the angled arm downward, and terminates in a u-shaped end, such that the lower diverter arm is folded upon itself.

DETAILED DESCRIPTION OF THE INVENTION

Figure 1:
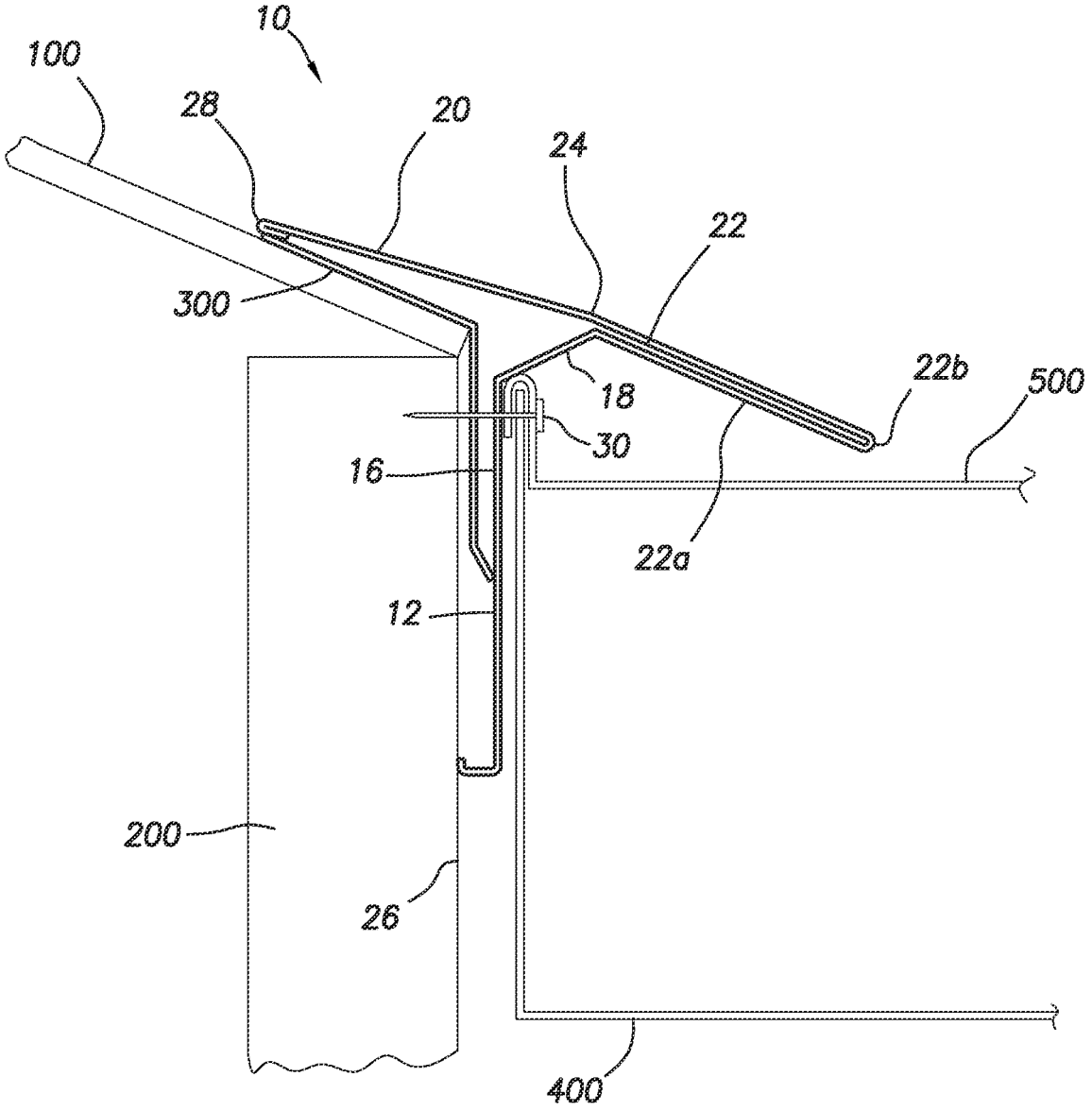
FIG. 1 is an end view of a gutter, drip edge, fascia board and roof decking, showing a gutter hanger, along with the improved gutter flashing of the present invention.
Figure 2:
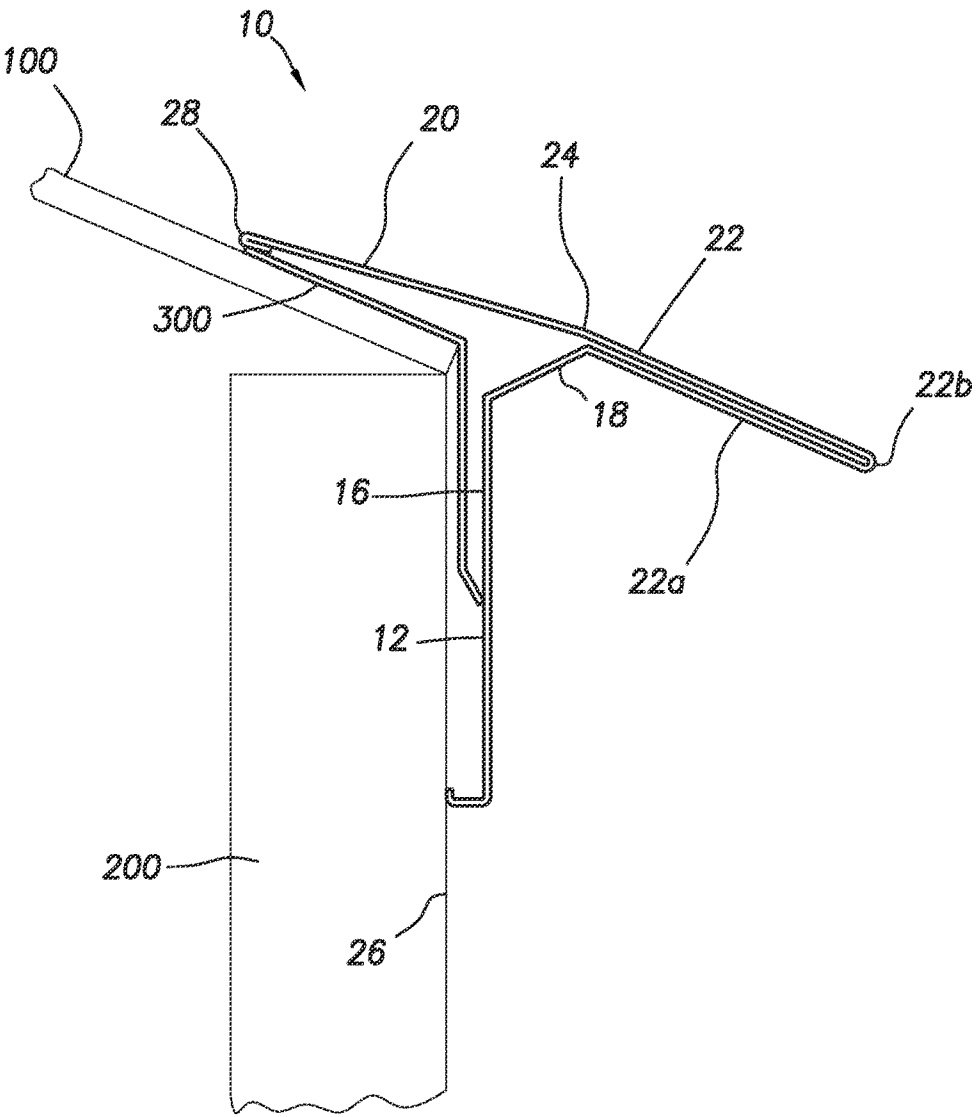
FIG. 2 is in an end view of the improved gutter flashing of the present invention abutted to a pre-existing roof line and fascia board.
Figure 4:
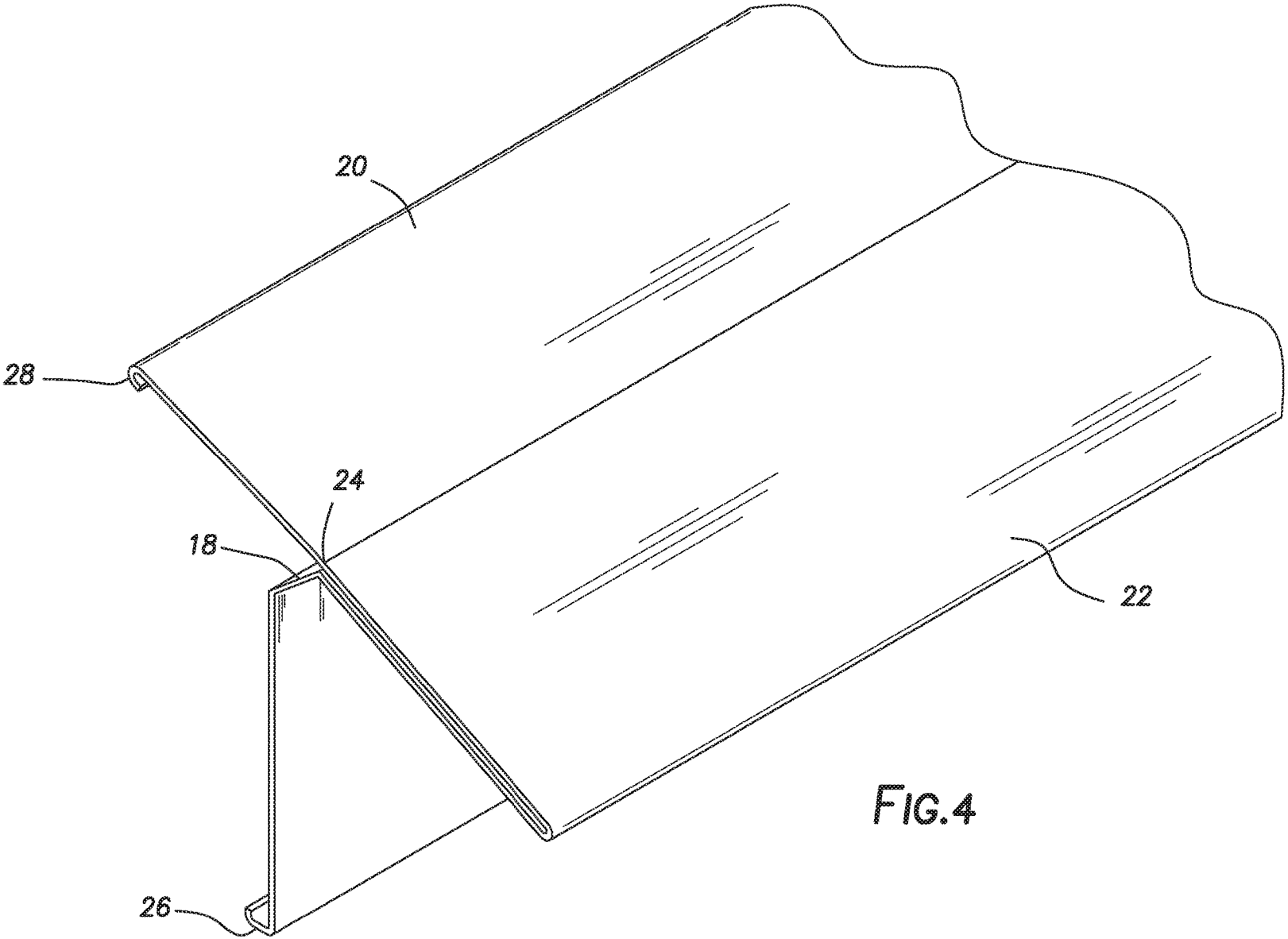
FIG. 4 is a prospective top view of the gutter flashing of the present invention.
Figure 5:
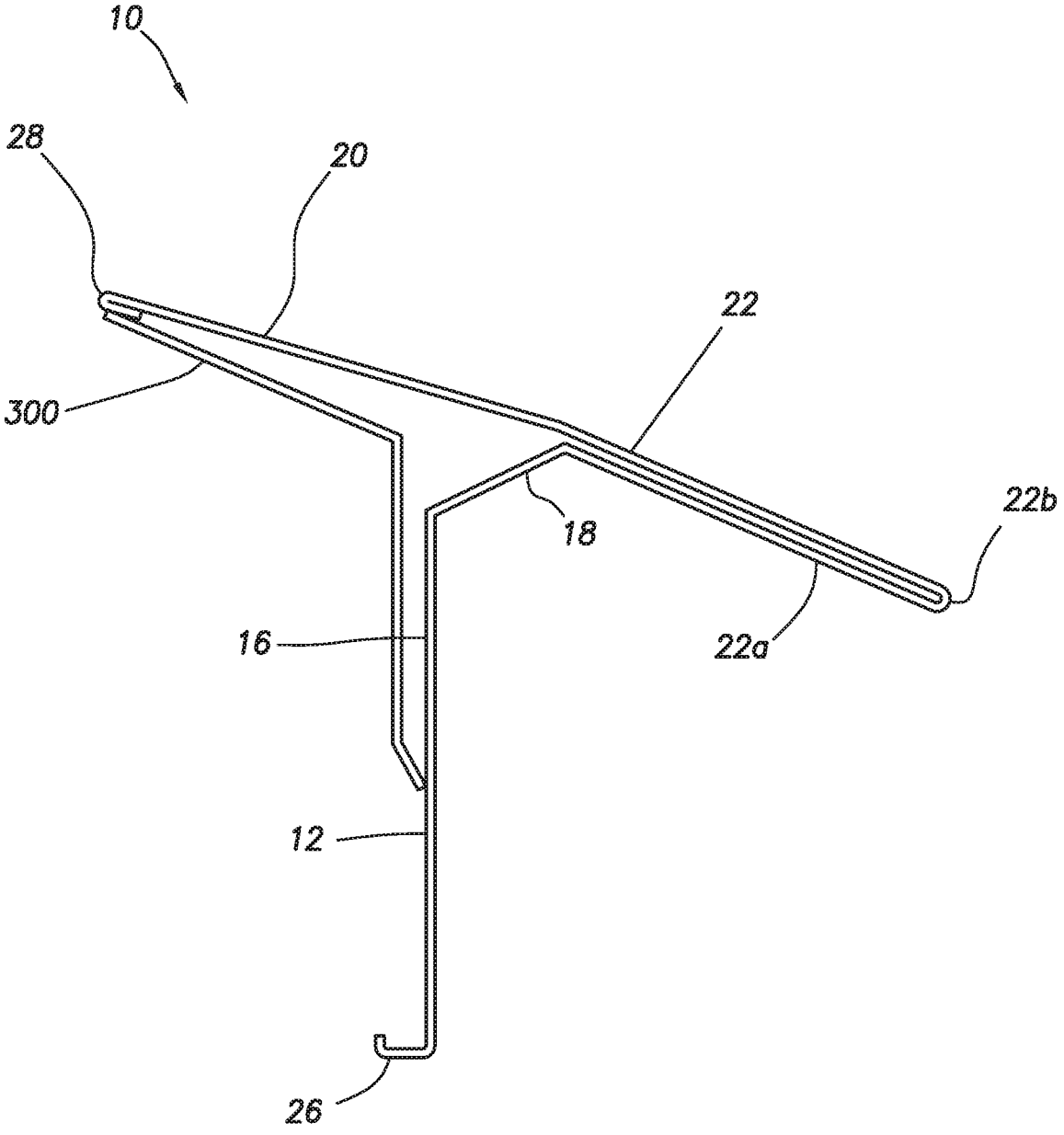
FIG. 5 is an end view of alternative embodiment of the gutter flashing of the present invention.

Referring to FIGS. 1, 2, 4 and 5, the improved gutter flashing 10 of the present invention is disclosed. FIG. 1 discloses the gutter flashing 10 of the present invention installed in an environment of a building (not shown) where an there is a pre-existing fascia board 200, roof decking 100 and pre-existing drip edge 300. Secured to the drip edge 300 is gutter 400 with a gutter hanger 500. FIG. 2 discloses the gutter flashing 10 of the present invention as attached to a pre-existing drip edge 300 along a structure (not shown) with roof 100 and fascia board 200.

As shown in FIG. 1, gutter 400 and gutter hanger 500 are secured to the fascia board 200 of the structure with nail 30. However, a screw (not shown), or other suitable attaching device (not shown) could be used, and are commonly known in the art. A pre-existing drip edge 300 is disposed between the roof decking 100 and the gutter flashing 10. Pre-existing drip edge 300 extends outward and downward from the roof line, and angles inward to form a substantially acute angle towards the fascia board 200. The existing drip edge 300 extends downward adjacent the fascia board 200. In other embodiments, the preexisting drip edge 300 terminates with a leg extending outward at a downward angle away from the building or structure. Pre-existing drip edges 300 are commonly known in the art and are typically secured to the fascia board 200, the roof decking 100, or both.

The gutter flashing 10 of the present invention is designed to be easily inserted into the environment just described without having to remove drip edge 300 from the roof 100 or the fascia board 200. The gutter flashing 10 can be installed directly on the fascia board 200, or can receive a preexisting drip edge 300 (if any). The gutter flashing 10 of the present invention comprises a vertical arm 12 which extends substantially vertically upwards and is substantially flat in one embodiment of the present invention (see FIG. 5).

Figure 3:
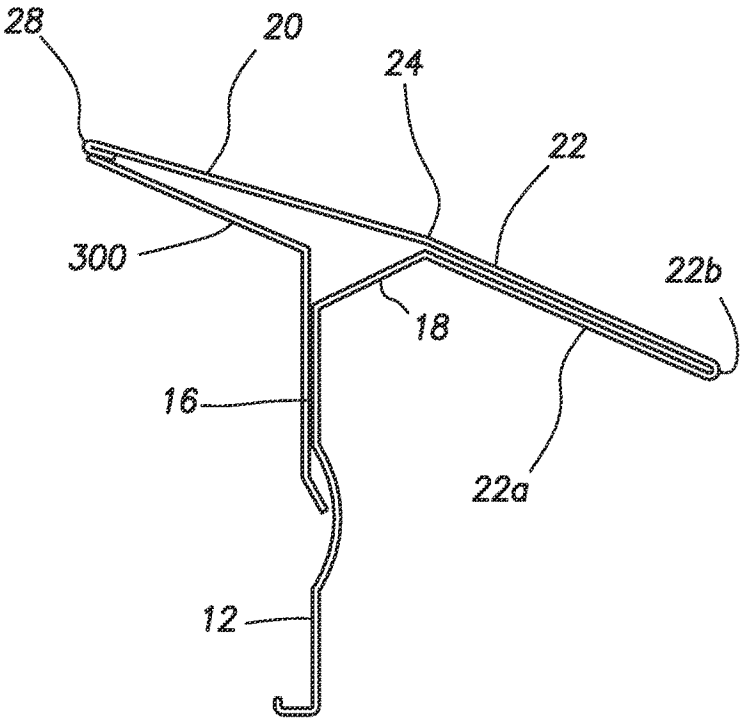
FIG. 3 is an end view of an alternative embodiment of the improved gutter flashing of the present invention.

However, in another aspect of the present invention as shown in FIG. 3, vertical arm 12 comprises a middle portion 14 that has a curved profile in such a way that middle section 14 curves outward, away from the fascia board 200 and toward the gutter 400. The purpose of the curvature of middle portion 14 is to create enough space to receive the lower angled leg of the pre-existing drip edge 300 such that the lower leg of pre-existing drip edge 300 does not contact middle portion 14, thereby eliminating wear and tear, and distortion or raising of the gutter 400 with respect to the pre-existing fascia board 200.

In the preferred embodiment, the vertical arm 12 is substantially flat and terminates in a substantially hook shape, thereby creating a spacer 26. It should be appreciated and understood that spacer 26 is designed to space vertical arm 12 from the fascia board 200, and should be of a sufficient horizontal length to receive angled legs and edges of preexisting drip edges such as drip edge 300.

Referring to FIGS. 1, 2, 4, and 5 the upper end 16 of vertical arm 12 is substantially flat and extends vertically upward to a point that is located spaced from, but substantially at the level where the fascia board 200 meets the roof decking 100. At that point, an angled arm 18 angles upward and outward from the upper end 16 of vertical arm 12. It should be understood to one of ordinary skill in the art that angled arm 18 is designed to be of an angle that is sufficiently outward from the roof line and fascia board 200 so as to provide a surface for receiving the acute angled portion of the pre-existing drip edge 300, but still upward enough that it will raise above, and not interfere with the upper edge of the gutter 400 and/or the gutter hanger 500, or any leaf protection devices (not shown).

An upper diverter arm 20 and lower diverter arm 22 are contiguous with one another, and join at a top portion 24 of angled arm 18. Lower diverter arm 22 and upper diverter arm 20 form the surface to divert water away from the roof decking 100 and fascia board 200 and into the gutter 400. Lower diverter arm 22 extends downward and outward from top portion 24 of angled arm 18 to a position that is, in the preferred embodiment, substantially along the longitudinal midline of the gutter 400. However, it should be understood that lower diverter arm 22 could be shorter, or longer depending on various factors with the gutter system such as whether or not there are gutter hangers 500, or the varying width of gutter 400. Lower diverter arm 22 can be customized in length to accommodate the gutter system. Moreover, lower diverter arm may be flexible or bendable, so that the angle of lower diverter arm 22 can be adjusted, or so leaf protection devices as are known in the art may be installed above the gutter, but below lower diverter arm 22. Lower diverter arm 22, it extends outward from angled arm 18 at the top portion thereof 24, forming a lower surface **22*b*. Lower diverter arm 22 then forms a substantially u-shaped curvature 22*a* and extends upward towards top portion 24 of angled arm 18**, creating an upper surface.

It should also be understood to one by one of ordinary skill marked that lower diverter arm 22 can be of a length that allows water to run off at a point within the gutter 400 other than the midline of the gutter 400, so long as it is of sufficient length to divert the water far enough away from the fascia board 200 so water cannot escape behind gutter 400 and the gutter flashing 10 of the present invention. It should also be understood to one of ordinary skill in the art that the termination point of lower diverter arm 22 should be at a position that is raised above the gutter 400, and not inside the gutter 400. As water runs down the shingles (not shown) attached to roof decking 100, the water runs across upper diverter arm 20, and lower diverter arm 22, and falls into the middle of the gutter, thereby diverting water away from fascia board 200 and the roof line. Lower diverter arm 22 should be of a sufficient downward angle to prevent water from rolling along the edge of lower diverter arm 22, and underneath such that it could potentially seep in between the interior wall of gutter 400 and the gutter flashing 10.

From top portion 24 of angled arm 18, upper diverter arm 20 extends in an upward direction, towards the roof line, and is substantially flat to receive the flat roof portion of pre-existing drip edge 300. Therefore, an acute angle is formed at the roof line, between angled arm 18 and the upward extension of upper diverter arm 20, while a substantially obtuse angle is created away from the roof line, by the angle of angled arm 18, and the extension of lower diverter arm 22. Along its top end, upper diverter arm 20 terminates in a hook portion 28, which should be substantially u-shaped. This design aids in smoothly sliding upper diverter arm 20 between preexisting drip edge 300 or roof decking 100 and the shingle of the roof.

Referring to FIG. 3, an alternative embodiment of the present invention is disclosed. In this embodiment, vertical arm 12 is substantially vertical, with curvature 14 to accommodate an angled leg of pre-existing drip edge 300. Referring to lower diverter arm 22, it extends outward from angled arm 18 at the top portion thereof 24, and terminates without a substantially "u" shaped surface, and comprises a single surface.

In one aspect of the present invention, vertical arm 12 of gutter flashing 10 could be approximately two to three inches in height, and more preferably two and half inches. However, different measurements may be applied depending on the particular installation measurements of the gutter system. Moreover; angled arm 18, in one aspect of the invention is one half inch to one inch, and in some aspects, preferably 0.65 inches. However longer shorter angle arms 18 may be contemplated depending on the measurements and factors of the gutter system. In another aspect of the present invention lower diverter arm 22 is between one and three inches, and preferably two inches, while upward diverter arm 20 is between one and three inches, and preferably two and a quarter inches. However, longer or shorter diverter arms 20 and 22 may be contemplated as needed depending on the measurements of the gutter system.

Although the invention has been described with reference to specific embodiments, this description is not meant to be construed in a limited sense. Various modifications of the disclosed embodiments, as well as alternative embodiments of the invention, as well as different lengths and sizes of the various parts of the present invention, will become apparent to persons of ordinary skill in the art upon the reference to the description of the invention. It is, therefore, contemplated that the appended claims will cover such modifications that fall within the scope of the invention.

I claim:

1. A drip edge for diverting water from a roof to a midline of a gutter comprising: a substantially vertical arm comprising a lower end, a middle portion and an upper end;

an angled arm adjacent said upper end and angling substantially upward and outward from said upper end of said vertical arm;

a lower diverter arm extending from an upper edge of said angled arm and angling downward and away from said vertical arm; and an upper diverter arm contiguous with said lower diverter arm at an upper end of said lower diverter arm and extending in an upward direction from the upper end of said lower diverter arm;

wherein said lower diverter arm and said angled arm join to define an obtuse angle and said upper diverter arm and said angled arm join to define an acute angle and said lower diverter arm extends sufficiently downwardly to prevent water from rolling along and underneath said lower diverter arm.

2. The drip edge for diverting water from a roof to a midline of a gutter as set forth in claim 1 wherein said lower end of said vertical arm comprises a spacing arm adjacent extending outward from a lower edge of said lower end.

3. The drip edge for diverting water from a roof to a midline of a gutter as set forth in claim 2 wherein said vertical arm comprises a vertical spacing arm adjacent said spacing arm and extending substantially vertically and parallel to said vertical arm, defining a channel with said spacing arm and said lower end of said vertical arm.

4. The drip edge for diverting water from a roof to a midline of a gutter as set forth in claim 3 wherein said upper diverter arm comprises a hook portion along an upper edge thereof.

5. The drip edge for diverting water from a roof to a midline of a gutter as set forth in claim 4 wherein said upper diverter arm and said lower diverter arm define a flat outer surface, extending in a downwardly and outwardly extending direction, defining a surface to divert water.

6. The drip edge for diverting water from a roof to a midline of a gutter as set forth in claim 4 wherein said upper diverter arm and said lower diverter arm define a downwardly angled surface above said upper edge of said angled arm.

7. A drip edge for diverting water from a roof to a midline of a gutter comprising: a substantially vertical arm comprising a lower end, a middle portion and an upper end;

an angled arm adjacent said upper end and angling substantially upward and outward from said upper end of said vertical arm;

a diverter arm extending from an upper edge of said angled arm comprising a first sidewall angling downward and away from said vertical arm, and a second sidewall adjacent and connected to said first sidewall and extending backward at a predefined angle upward and outward from said angled arm, and said diverter arm extends sufficiently downwardly to prevent water from rolling along and underneath said lower diverter arm; and wherein said diverter arm and said angled arm join to define an obtuse angle and an acute angle opposite said obtuse angle.

8. The drip edge for diverting water from a roof to a midline of a gutter as set forth in claim 7 wherein said lower end of said vertical arm comprises a spacing arm adjacent extending outward from a lower edge of said lower end.

9. The drip edge for diverting water from a roof to a midline of a gutter as set forth in claim 8 wherein said vertical arm comprises a vertical spacing arm adjacent said spacing arm and extending substantially vertically and parallel to said vertical arm, defining a channel with said spacing arm and said lower end of said vertical arm.

10. The drip edge for diverting water from a roof to a midline of a gutter as set forth in claim 9 wherein said diverter arm comprises a hook portion along an upper edge thereof to receive the edge of a preexisting gutter flashing.

11. The drip edge for diverting water from a roof to a midline of a gutter as set forth in claim 10 wherein said diverter arm defines a flat outer surface, extending in a downward and outward direction, defining a surface to divert water.

12. The drip edge for diverting water from a roof to a midline of a gutter as set forth in claim 10 wherein said diverter arm defines a downwardly angled surface above said upper edge of said angled arm.

* * * * *